US008764254B2

(12) United States Patent
Kim et al.

(10) Patent No.: US 8,764,254 B2
(45) **Date of Patent: *Jul. 1, 2014**

(54) LIGHTING APPARATUS

(75) Inventors: Kyunghyun Kim, Seoul (KR); Yongseog Jeon, Seoul (KR); Sejoon You, Seoul (KR); Kyungnam Park, Seoul (KR)

(73) Assignee: LG Electronics Inc., Seoul (KR)

( * ) Notice: Subject to any disclaimer, the term of this patent is extended or adjusted under 35 U.S.C. 154(b) by 272 days.

This patent is subject to a terminal disclaimer.

(21) Appl. No.: 13/300,170

(22) Filed: Nov. 18, 2011

(65) Prior Publication Data

US 2012/0300481 A1 Nov. 29, 2012

(30) Foreign Application Priority Data

May 23, 2011 (KR) ..... 10-2011-0048425

(51) Int. Cl.
*F21V 19/02* (2006.01)
*F21S 8/08* (2006.01)

(52) U.S. Cl.
USPC ..... 362/418; 362/431; 362/294; 362/427

(58) Field of Classification Search
None
See application file for complete search history.

(56) References Cited

U.S. PATENT DOCUMENTS

| | | | | |
|---|---|---|---|---|
| 3,142,501 | A * | 7/1964 | Clark et al. | 285/184 |
| 3,387,866 | A * | 6/1968 | Baldwin | 285/184 |
| 4,426,676 | A * | 1/1984 | Taylor | 362/371 |
| 6,161,948 | A | 12/2000 | Hagen | |
| 6,419,378 | B1 * | 7/2002 | Wedell et al. | 362/431 |
| 7,108,405 | B2 * | 9/2006 | Matts et al. | 362/418 |
| 7,278,761 | B2 * | 10/2007 | Kuan | 362/294 |
| 7,390,110 | B2 * | 6/2008 | Katz et al. | 362/382 |
| 7,583,184 | B2 * | 9/2009 | Schofield et al. | 340/438 |
| 7,619,508 | B2 * | 11/2009 | Lynam et al. | 340/438 |
| 7,628,463 | B2 * | 12/2009 | Sasaki | 347/11 |
| 8,021,026 | B2 * | 9/2011 | Liu et al. | 362/419 |
| 8,277,080 | B2 * | 10/2012 | Duffy et al. | 362/249.02 |
| 2009/0237927 | A1 * | 9/2009 | Zheng et al. | 362/235 |

FOREIGN PATENT DOCUMENTS

| | | | |
|---|---|---|---|
| JP | 2007-335229 | | 12/2007 |
| KR | 10-2009-0080383 | | 7/2009 |
| KR | 200447348 | | 1/2010 |
| KR | 1020100100473 | * | 9/2010 |
| KR | 101014165 | * | 2/2011 |

* cited by examiner

*Primary Examiner* — Ashok Patel
(74) *Attorney, Agent, or Firm* — KED & Associates LLP

(57) ABSTRACT

A lighting apparatus may include a body having a substrate, and a light emitting module with a light emitting diode (LED) mounted to the substrate. A connection member may be provided to the body, and a support member may be mounted to the connection member at a predetermined tilt angle thereto to adjust a light directing angle of the body.

20 Claims, 8 Drawing Sheets

(a)

(b)

(a)

(b)

LIGHTING APPARATUS

CROSS-REFERENCE TO RELATED APPLICATION

This application claims priority under 35 U.S.C. §119 from Korean Application No. 10-2011-0048425 filed May 23, 2011 the subject matter of which is hereby incorporated by reference.

BACKGROUND

1. Field

Embodiments may relate to a lighting apparatus.

2. Background

Incandescent lamps, discharge lamps, and fluorescent lamps may be used for lighting in various purposes such as domestic, landscape and industrial purposes.

Resistant light sources, such as the incandescent lamps, may have problems of poor efficiency and substantial heat generation. Discharge lamps may have problems of a high price and a high voltage. Fluorescent lamps may have an environmental problem caused by mercury.

A light emitting diode (LED) may be used to solve drawbacks of light sources. The LED may have advantages in efficiency, variety of colors, autonomy of design, etc.

The light emitting diode is a semiconductor device that emits a light when a voltage is applied thereto in a forward direction. The light emitting diode may have a long lifetime, a low power consumption, and/or electric, optical and physical characteristics suitable for mass production, to rapidly replace incandescent lamps and fluorescent lamps. The light emitting diode may be applied to lighting apparatuses, such as street lamps, security lamps, and/or park lamps.

The lighting apparatus may be hung from a pole member. The lighting apparatus may direct a light at an optimum angle based on an environment.

A lighting apparatus, such as the street lamp, may be installed at a site after being produced in a state of a tilting angle thereof with respect to a road surface or an installation surface. Accordingly, the tilting angle of the lamp with respect to the road surface or the installation surface may not be adjustable at a time of actual installation.

If the street lamp is installed incorrectly, such as failing to have a correct angle with respect to the road surface or the installation surface, light may be directed to an unnecessary region, and/or brightness of a region that requires illumination may become poor.

BRIEF DESCRIPTION OF THE DRAWINGS

Arrangements and/or embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings. Wherever possible, same reference numbers may be used throughout the drawings to refer to same or like parts, repetitive description may be omitted, and a size or a shape may be exaggerated, for ease of description.

Although terms (including ordinal numbers such as first or second) may be used for describing various elements, the elements are not limited by the terms, and may be used only for making one element distinctive from other elements.

Figure 1A:
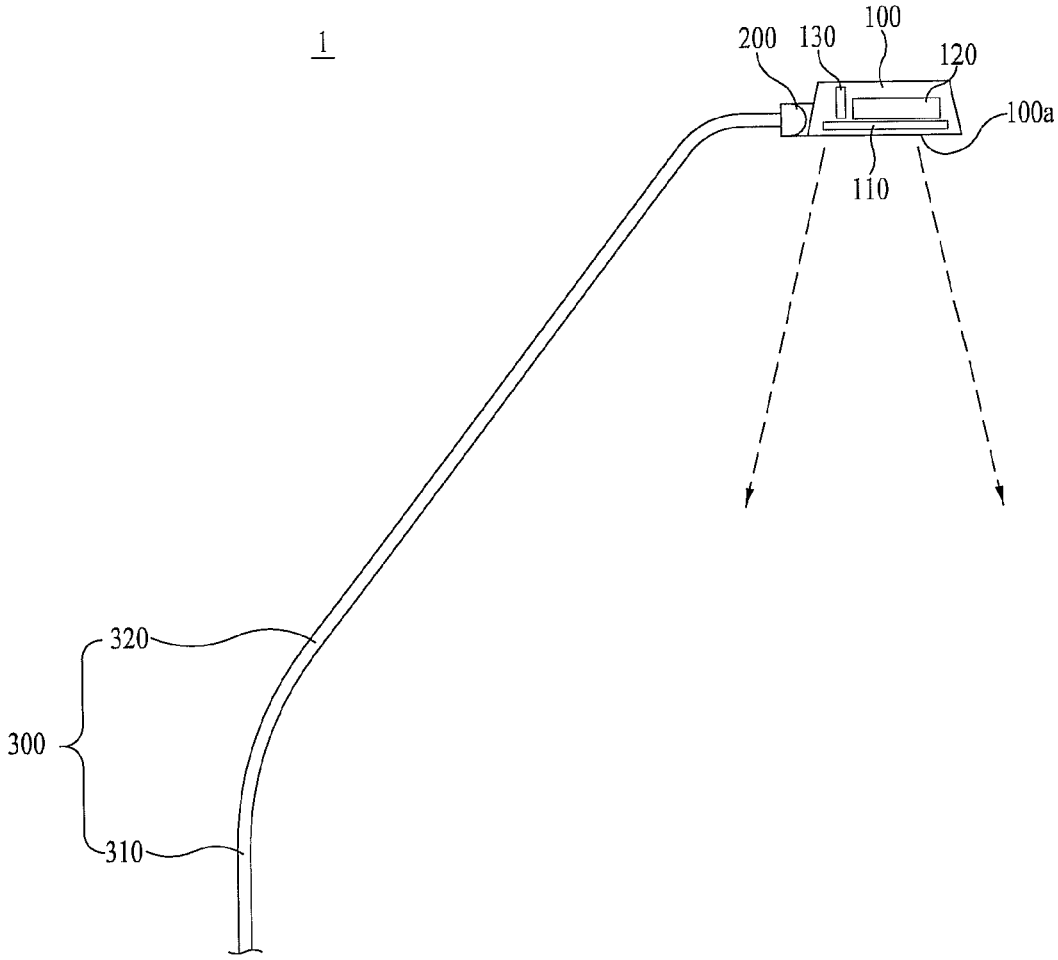
FIGS. 1A and 1B illustrate schematic views of a lighting apparatus in accordance with an embodiment.
Figure 1B:
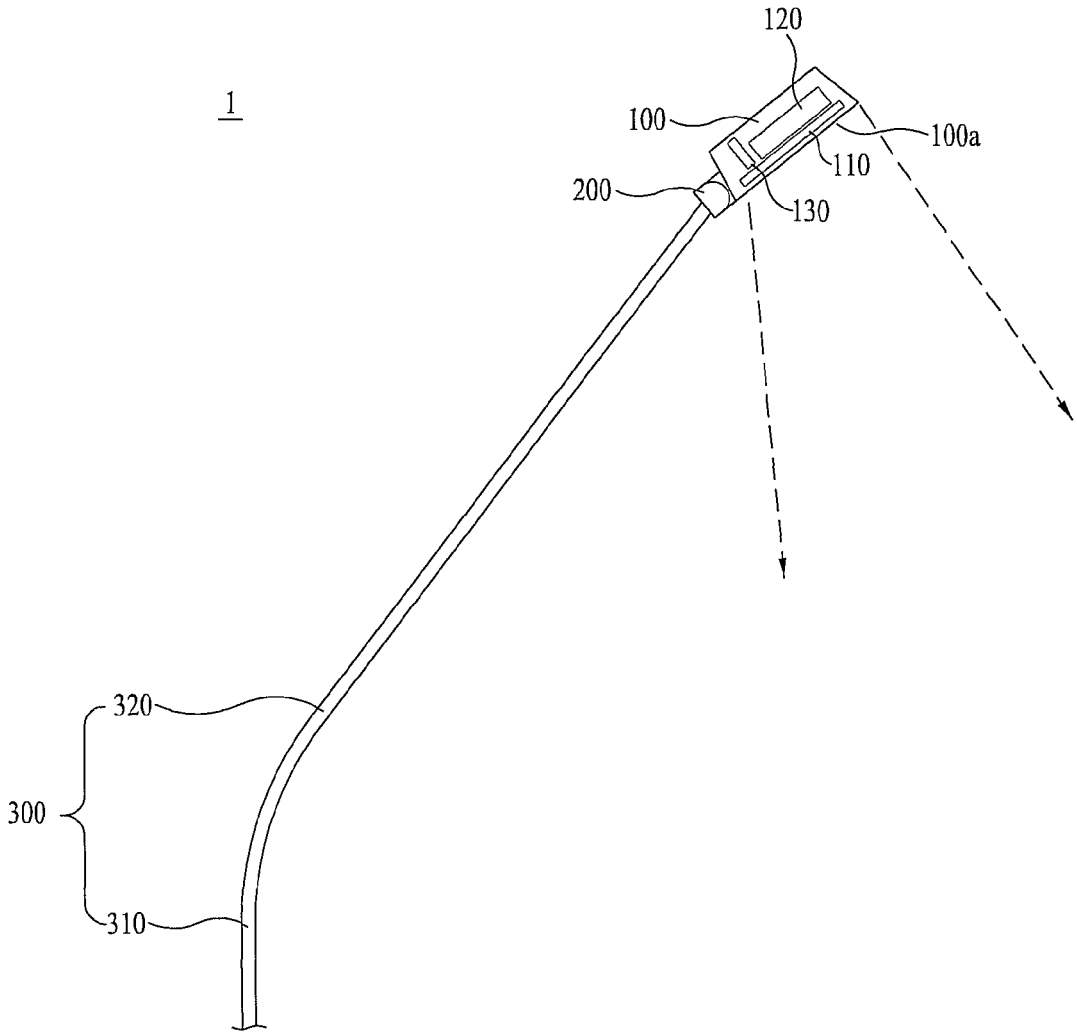
Figure 2:
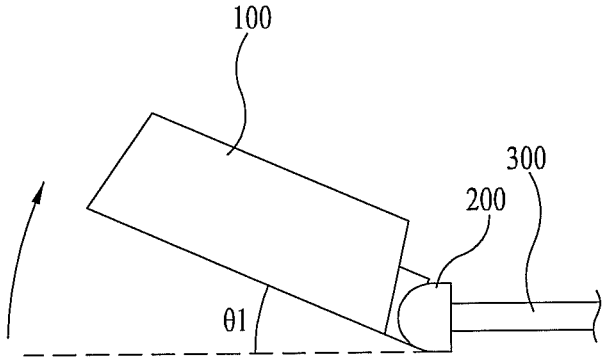
FIGS. 2A and 2B illustrate side views of a lighting apparatus in accordance with an embodiment.
Figure 2:
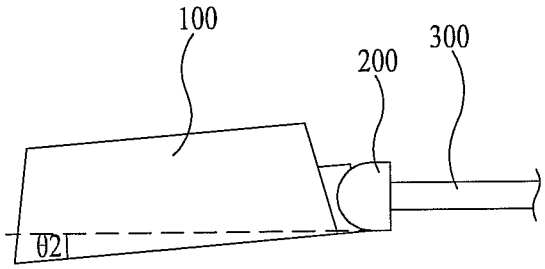

FIGS. 1A and 1B illustrate schematic views of a lighting apparatus in accordance with an embodiment. FIGS. 2A and 2B illustrate side views of a lighting apparatus in accordance with an embodiment. FIGS. 3A and 3B illustrate perspective views of a lighting apparatus in accordance with an embodiment.

Figure 3:
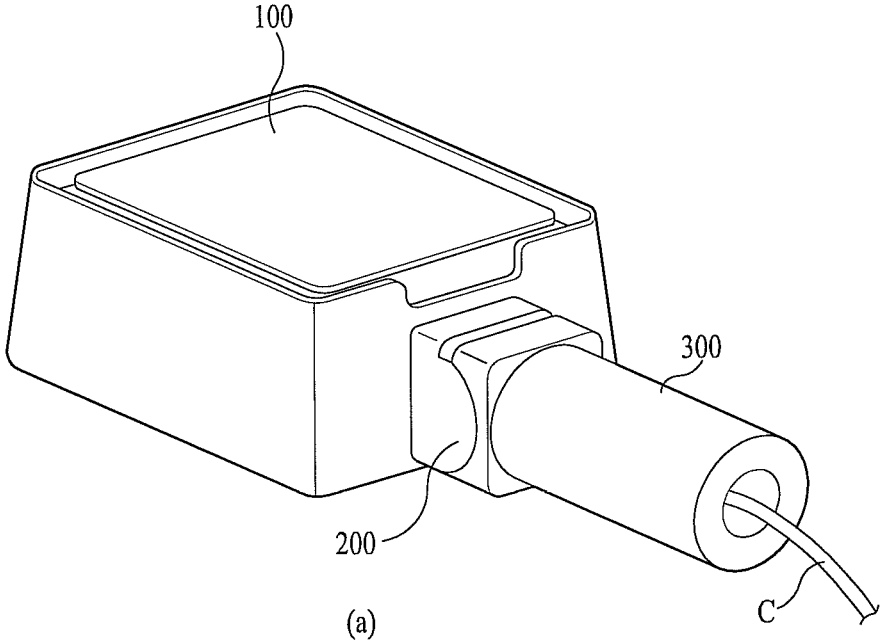
FIGS. 3A and 3B illustrate perspective views of a lighting apparatus in accordance with an embodiment.
Figure 3:
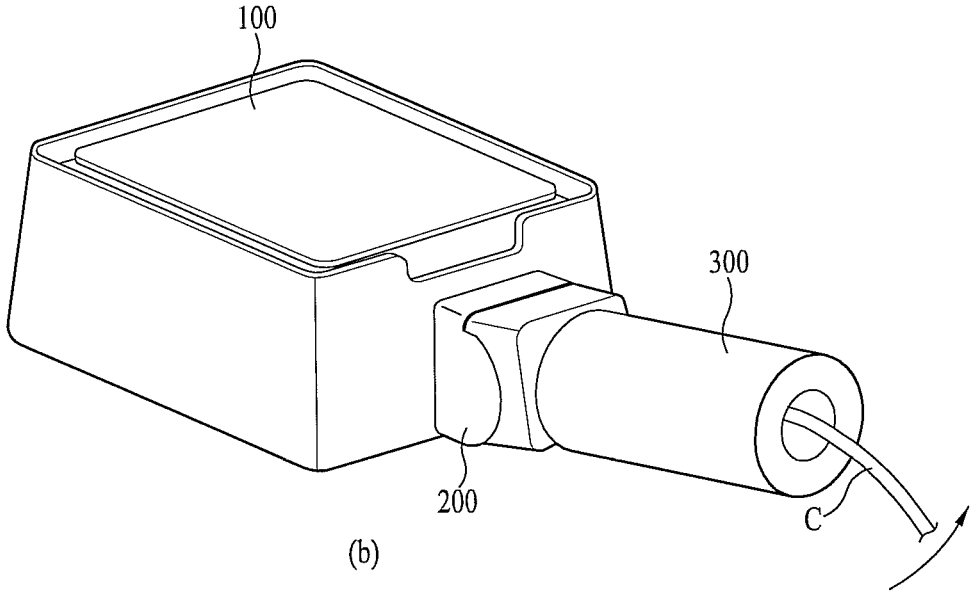
Figure 4:
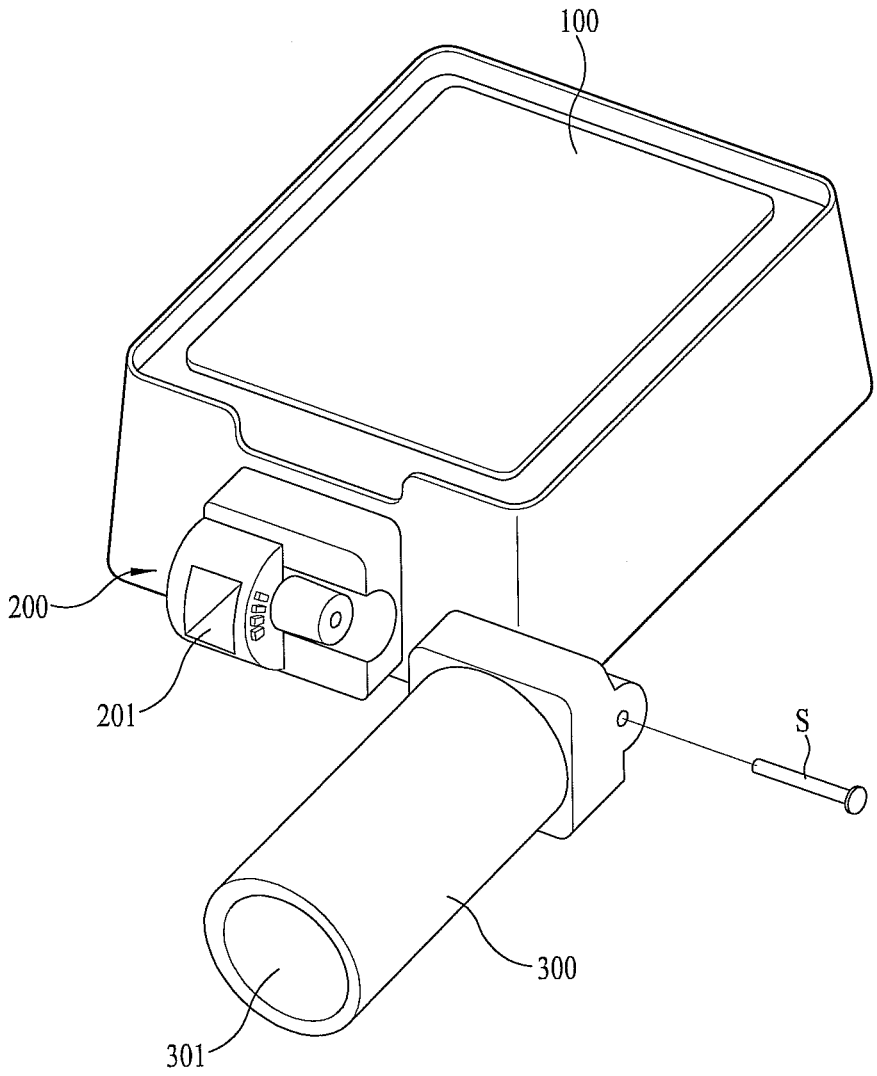
FIG. 4 illustrates an exploded perspective view of the lighting apparatus in FIG. 3.
Figure 5:
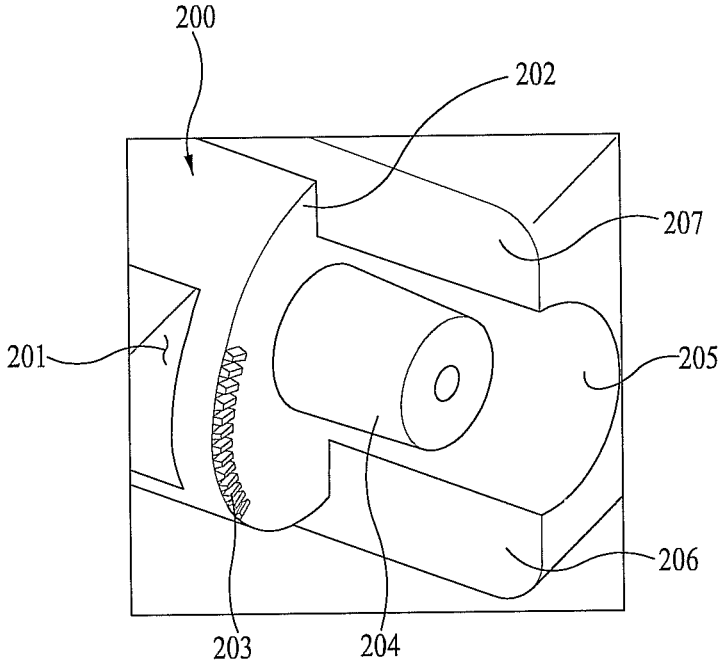
FIGS. 5A and 5B illustrate perspective views of a connection member and a support member of a lighting apparatus in accordance with an embodiment.
Figure 5:
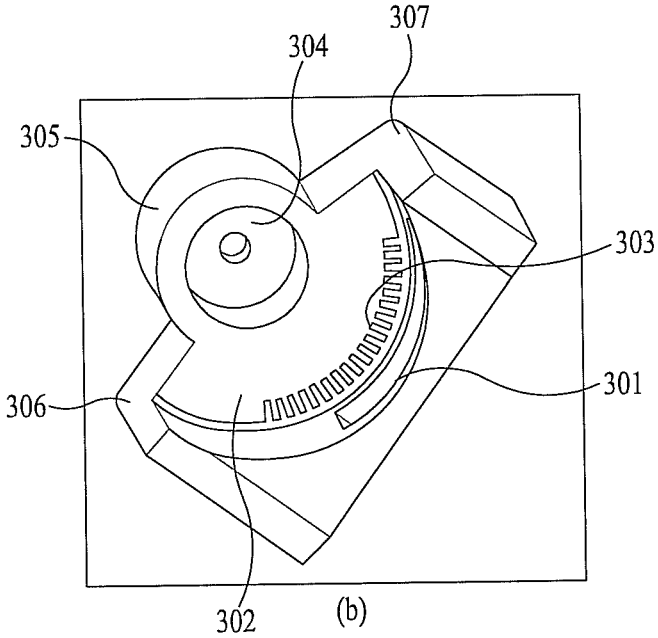
Figure 6:
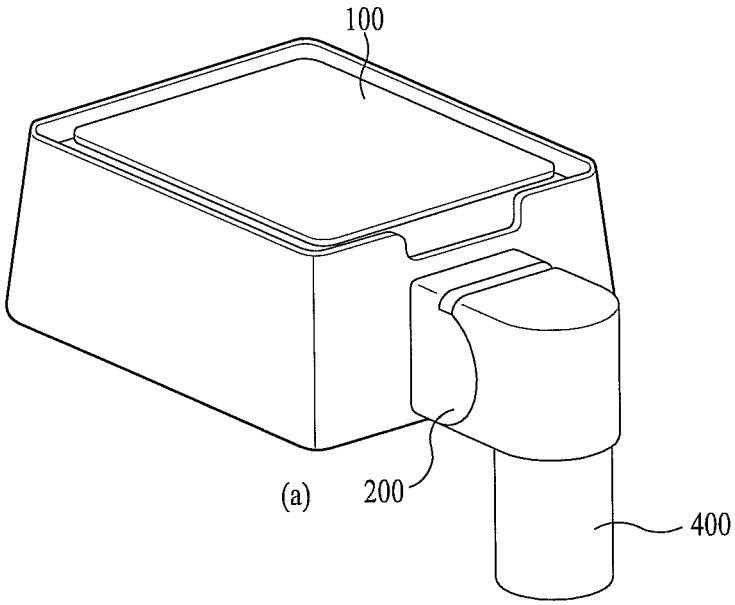
FIGS. 6A and 6B illustrate perspective views of a lighting apparatus in accordance with an embodiment.
Figure 6:
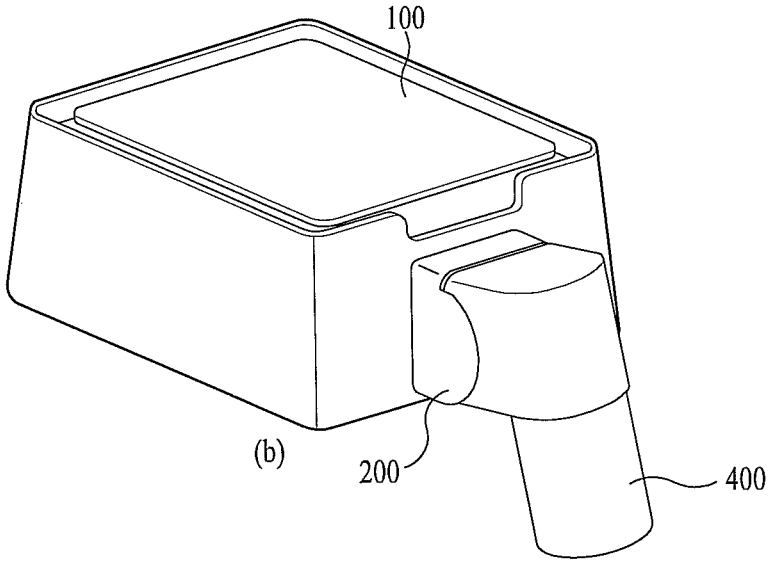
Figure 7:
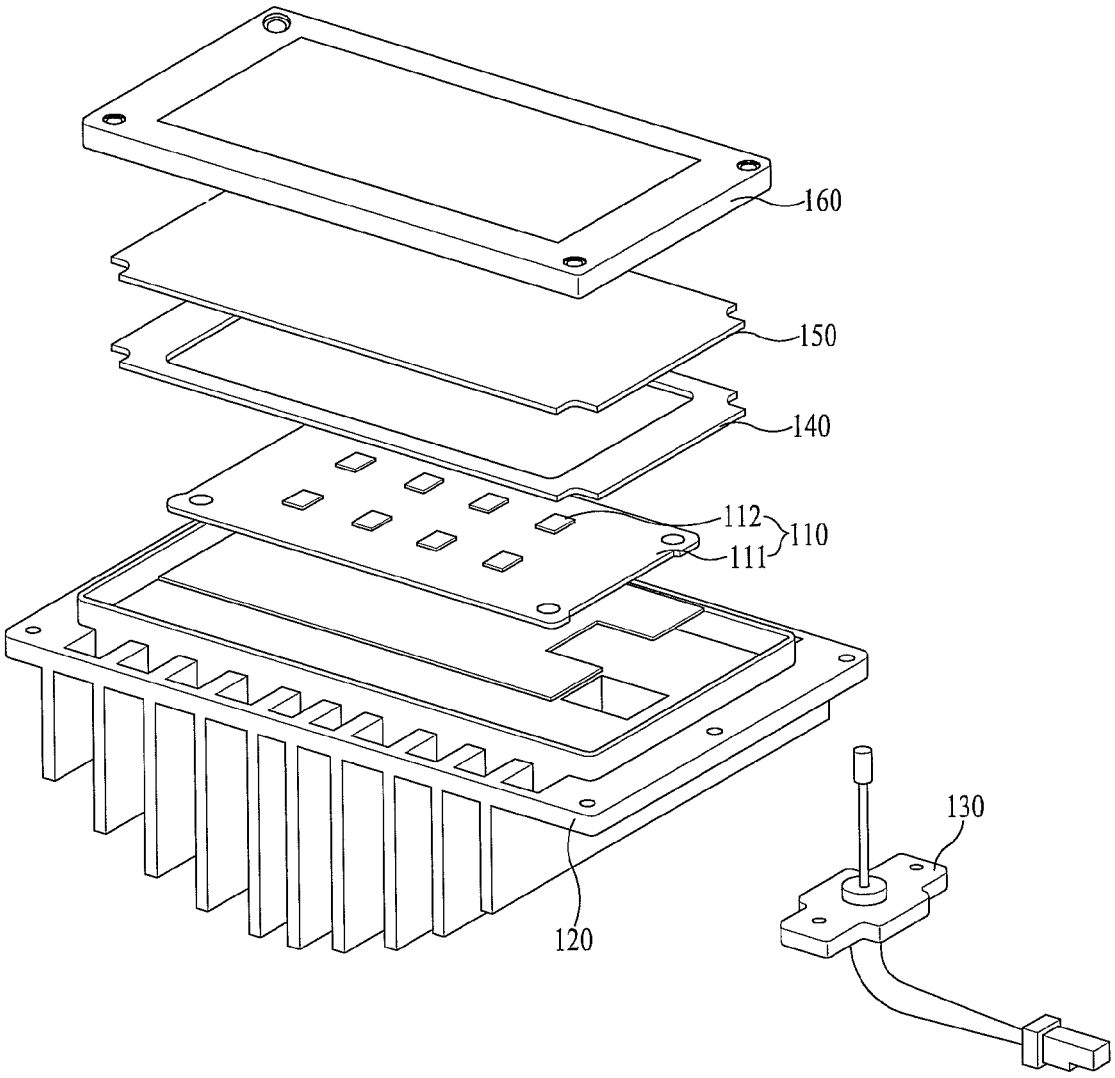
FIG. 7 illustrates an exploded perspective view of a lighting apparatus in accordance with an embodiment.

FIG. 4 illustrates an exploded perspective view of the lighting apparatus in FIG. 3. FIGS. 5A and 5B illustrate perspective views of a connection member and a support member of a lighting apparatus in accordance with embodiment. FIGS. 6A and 6B illustrate perspective views of a lighting apparatus in accordance with an embodiment. FIG. 7 illustrates an exploded perspective view of a lighting apparatus in accordance with an embodiment. Other embodiments and configurations may also be provided.

A lighting apparatus 1 may include all lighting apparatuses, such as a street lighting apparatus. For ease of description, the following description may be provided with respect to a street lighting apparatus.

The lighting apparatus 1 may include a body 100 for directing a light to a lighting space, a connection member 200 provided at one longitudinal end portion of the body 100, and a support member 300 for connecting (or mounting) to the connection member 200 at a predetermined tilt angle. The connection member 200 and the support member 300 may adjust a light directing angle of the body 100.

The body 100 may include a substrate 111, a light emitting module 110 with a light emitting diode (LED) 112 mounted to the substrate 111, and a heat sink 120 to dissipate heat from the light emitting module 110. The connection member 200 may be provided to the body 100.

The following description may discuss a tilt position (or tilt region). This may be a tilt position of the connection member 200 (or the body 100) with respect to the support member 300. FIG. 2A shows a first tilt position θ1 (or first tilt region) for making the body 100 tilt in a first light direction of the light emitting module 110. FIG. 2B shows a second tilt position θ2 (or second tilt region) for making the body 100 tilt in a second light direction of the light emitting module 110. The second tilt position θ2 may be in a direction opposite to the first tilt position θ1. The first tilt position may be a greater angle with respect to the dotted line (FIG. 2A) than the second tilt position with respect to the dotted line (FIG. 2B).

The connection member 200 may have a first stopper 206 and a second stopper 207 for preventing (or stopping) the support member 300 from moving beyond the first tilt position θ1 and the second tilt position θ2, respectively.

Referring to FIGS. 1A and 1B, the body 100 and the connection member 200 may be mounted to the support unit 300 at one of a plurality of tilt angles (or tilt positions). For example, the body 100 and the connection member 200 may be mounted at an angle of 0° with respect to a road surface or an installation surface that is parallel thereto, or may be mounted at an angle of 5°~8° with respect to a road direction (i.e., the light direction) or opposite to the road direction.

The support member 300 may have a pole portion 310 and an arm portion 320. The pole portion 310 and the arm portion 320 may have a variety of different shapes and/or sizes based on specialty and design characteristics of the installation space. As shown in FIG. 6, the support member 300 may only have the pole portion 400 (without an arm portion).

The connection member 200 may be formed with the body 100 as one unit, and the connection member 200 may be attached to one longitudinal end portion of the support member 300 at a predetermined angle with respect to the connection member 200. The connection member 200 and the support member 300 may be assembled at a predetermined tilt angle while at an installation site.

Referring to FIG. 7, the body 100 may include the heat sink 120 mounted to the substrate 111 and a power supply unit 130 to electrically connect to the light emitting module 110.

The heat sink 120 may dissipate heat from the LED 112 when the LED 112 is turned on. The heat sink 120 may be formed of a metal having a high heat conductivity, and the heat sink 120 may have heat dissipating fins for increasing a heat dissipating area. The power supply unit 130 may include a converter for converting external power and for supplying the same to the light emitting module 110.

Since the light emitting module 110, the heat sink 120, and the power supply unit 130 are all provided to an inside of the body 100, a fixing structure and a tilt angle adjusting structure for the support member 300 and the connection member 200 may be important to deal with the heavy body 100.

Referring to FIGS. 3A, 3B and 4, the connection member 200 may have a pass through hole 201 and the support member 300 may have a pass through hole 301. A cable C electrically connected to the power supply unit 130 may be provided to an outside of the lighting apparatus 1 through the pass through holes 201 and 301.

Referring to FIG. 7, the body 100 may include a lens or a diffusing member 150 provided in front of the light emitting module 110, a frame 140 provided between the lens or the diffusing member 150 and the substrate 111 to maintain a predetermined gap therebetween, and a cover 160 for surrounding a periphery of the lens or the diffusing member 150.

The cover 160 and the lens or the diffusing member 150 may form a light emission face 100*a* of the body 100 as shown in FIG. 1. The cover 160 may have a longitudinal edge portion that is rotatably mounted to the body 100, to selectively open/close an inside of the body 100 for inspection of the light emitting module 110.

Referring to FIGS. 4, 5A and 5B, the connection member 200 may have a first recess 205 and an inserting projection 204 provided in the first recess 205. The support member 300 may have a surrounding projection 305 to be provided in the first recess 205 and a second recess 304 provided in the surrounding projection 305 to receive the inserting projection 204.

The inserting projection 204 and the second recess 304 may have circular sections (or curved sections) for providing a smooth relative rotation between the connection member 200 and the support member 300. The surrounding projection 305 and the first recess 205 may include curved surfaces having a predetermined curvature, respectively.

The inserting projection 204 may make surface to surface contact with one side of the connection member 200. The connection member 200 may have a first surface 202 that makes surface to surface contact with a second surface 302 of the support member 300. This may increase a friction area for preventing the connection member 200 from slipping from the support member 300 in a state that the connection member 200 is mounted to the support member 300 at a predetermined tilt angle.

The inserting projection 204 may extend in a perpendicular manner from the first surface 202 of the connection member 200. The second surface 302 of the support member 300 may have the second recess 304 provided therein.

The connection member 200 and the support member 300 may be fastened together with a screw S that fastens to the inserting projection 204 after passing through the second recess 304.

The support member 300 may have a first contact 306 and a second contact 307 on both sides of the surrounding projection 305, which are extensions therefrom.

Referring to FIGS. 2A, 2B and 4, the connection member 200 may have a first stopper 206 (or a first stopping portion) that contacts the first contact 306 at a greatest rotation angle toward the first tilting position θ1, and the connection member 200 may have a second stopper 207 (or a second stopping portion) that contacts the second contact 307 at a greatest rotation angle toward the second tilting position θ2. The first stopper 206 and the second stopper 207 may have slope angles different from each other.

The first contact 306 and the second contact 307 may have different slope angles. More particularly, a slope angle of the second contact 307 positioned in a direction in which the body 100 is lifted with respect to the road surface (or the installation surface) may be steeper than the slope angle of the first contact 306. Accordingly, a great space may be provided in the direction that the body 100 is lifted.

The first stopper 206 and the second stopper 207 may be provided to both sides of the first recess 205, wherein the second contact 307 in the first tilting position θ1 is not brought into contact with the connection member 200. More specifically, the second stopper 207 and the first contact 306 in the second tilting position θ2 are not brought into contact with the connection member 200, and more specifically the first stopper 206.

Referring to FIGS. 3A, 5A and 5B, the body 100 and the connection member 200 may be mounted to the support member 300 such that the first contact 306 (of the support member 300) contacts the first stopper 206 (of the connection member 200). In this example, the body 100 and the connection member 200 may be mounted to the support member 300 at a predetermined tilt angle (for example, 0°) with respect to the support member 300. In this example, at the tilt angle, the second contact 307 is not in contact with the second stopper 207.

Differently, referring to FIGS. 3B, 5A and 5B, the body 100 and the connection member 200 may be mounted to the support member 300 such that the second contact 307 (of the support member 300) contacts the second stopper 207 (of the connection member 200). In this example, the body 100 and the connection member 200 may be mounted to the support member 300 at a predetermined tilt angle (for example, 8°) with respect to the support member 300. In this example, at the tilt angle, the first contact 306 is not in contact with the first stopper 206.

Thus, due to a contact structure of the contact portions 306 and 307 and the stoppers 206 and 207 corresponding thereto, the lighting apparatus 1 may prevent the body 100 from drooping, and/or may enhance reliability.

The connection member 200 may be prevented from slipping on the support member 300 in a state that the connection member 200 is arranged to the support member 300 at a predetermined tilt angle.

The connection member 200 may have a first projection portion 203 and the support member 300 may have a second projection portion 303 that engages with the first projection portion 203 for adjusting the tilt angle.

The first projection portion 203 and the second projection portion 303 may each have a plurality of projections spaced at predetermined intervals in a tilting direction of the connection member 200, respectively. The first contact 306 may be formed on the first surface 202 (of the connection member 200), and the second projection portion 303 may be formed on the second surface 302 (of the support member 300).

Any one projection of the second projection portion 303 may be arranged between two adjacent projections of the first projection portion 203.

The tilt angle may be determined by a total number of projections and a space between each of the projections of the projection portions 203 and 303. The tilt angle may be adjusted within a range from a smallest tilt angle to a greatest tilt angle based on the projection portions 203 and 303.

The engaging structure of the projection portions 203 and 303 may maintain a tilt angle to prevent the connection member 200 from slipping from the support member 300 as a projection of the second projection portion 303 engages between a space of two adjacent projections of the first projection portion 203 pertinent to the tilt angle.

Although an example has been described in which the connection member 200 and the support member 300 have the first projection portion 203 and the second projection portion 303 respectively, embodiments are not limited to this arrangement.

For example, at least one of the support member 300 or the connection member 200 may have the projection portion provided thereto for adjusting the tilt angle, and the other one may have a recess to engage with the projection portion.

A process for assembling the connection member 200 and the support member 300 may be described with reference to the attached drawings.

After determining the tilt angle of the connection member 200 and the support member 300 with respect to a road environment (or the installation environment), the first projection portion 203 (of the connection member 200) may engage with the second projection portion 303 (of the support member 300).

In this example, if a particular projection of the second projection portion 303 engages with a space between two adjacent projections of the first projection portion 203, the inserting projection 204 (of the connection member 200) may be provided in the second recess 304 (of the support member 300). The surrounding projection 305 (of the support member 300) may be received in the first recess 205 (of the connection member 200).

The connection member 200 and the support member 300 may be fastened together with the screw S. The screw S may be fastened to the inserting projection 204 after passing through the second recess 304.

The lighting apparatus may adjust an angle thereof to freely suit to a lighting space.

The lighting apparatus may adjust a light distribution so as to be proper to the installation site, to increase light efficiency and/or to save energy.

The lighting apparatus may reduce a number of components, reduce a production cost and/or enhance reliability.

An embodiment may provide a lighting apparatus that adjusts a light distribution at an installation site, increases a lighting efficiency, and/or saves energy.

An embodiment may provide a lighting apparatus to reduce a total number of components and a production cost.

A lighting apparatus may include a body having a substrate, a light emitting module with a LED mounted to the substrate, and a heat sink for dissipating heat from the light emitting module. The lighting apparatus may include a connection member provided to the body, and a support member mounted to the connection member at a predetermined tilt angle thereto for adjusting a light directing angle of the body.

A first tilt angle (or position) for making the body to tilt in a light directing direction of the light emitting module may be smaller than a second tilt angle (or position) that is in a direction opposite to the first tilt region.

The connection member may have a first stopper and a second stopper for preventing the support member from moving beyond the first tilt angle (or position) and the second tilt angle (or position), respectively.

The first stopper and the second stopper may have slope angles different from each other.

The connection member and the support member may have a first projection portion and a second projection portion to engage with the first projection portion for adjusting the tilt angle, respectively.

Each of the first projection portion and the second projection portion may include a plurality of projections spaced at predetermined intervals along tilt directions of the connection member.

The first projection portion and the second projection portion may include projections in numbers different from each other.

One of the connection member and the support member may include a projection portion and the other one of the connection member and the support member may include a recess portion engaged with the projection portion for adjusting a tilt angle.

The connection member may have a first recess and an inserting projection positioned in the first recess. The support member may have a surrounding projection to be provided in the first recess, and a second recess for receiving the inserting projection therein.

The connection member and the support member may be fastened by a screw fastened to the inserting projection after passing through the second recess.

The support member may have a first contact and a second contact at both sides of the support member. Both sides may be extensions from the surrounding projection, for bringing into contact with the first stopper and the second stopper, respectively.

The first stopper and the second stopper may be provided to both sides of the first recess, respectively.

The first stopper and the second stopper may have slope angles different from each other.

The body may include a power supply unit to electrically connect to the light emitting module, and a cable connected to the power supply unit may be provided to an outside of the lighting apparatus that passes through the connection member and the support member.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a body having a substrate, a light emitting module with a light emitting diode (LED) mounted to the substrate, and a heat sink to dissipate heat from the light emitting module;

a connection member provided to the body; and a support member mounted to the connection member at a predetermined tilt angle, wherein the connection member includes a first stopper to prevent the body from moving beyond a first tilt position relative to the support member, and the connection member includes a second stopper to prevent the body from moving beyond a second tilt position relative to the support member, wherein the light emitting module to provide the light in a first light direction when the body is in the first tilt position relative to the support member, and the light emitting module to provide light in a second light direction when the body is in the second tilt position relative to the support member.

2. The lighting apparatus of claim 1, wherein the support member includes:

a first contact to contact the first stopper and to prevent the body from moving beyond the first tilt position relative to the support member, and a second contact to contact the second stopper and to prevent the body from moving beyond the second tilt position relative to the support member.

3. The lighting apparatus of claim 1, wherein the first stopper and the second stopper have different slope angles.

4. The lighting apparatus of claim 1, wherein the connection member further includes a first projection portion, and the support member further includes a second projection portion to engage with the first projection portion for adjusting a position of the body relative to the support member.

5. The lighting apparatus of claim 4, wherein the first projection portion includes a first plurality of projections spaced at intervals on the connection member, and the second projection portion includes a second plurality of projections spaced at intervals on the support member.

6. The lighting apparatus of claim 5, wherein the first plurality of projections includes a first total number of projections and the second plurality of projections includes a second total number of projections.

7. The lighting apparatus of claim 1, wherein one of the connection member and the support member includes an inserting projection, and the other one of the connection member and the support member includes a recess to engage with the inserting projection for adjusting a position of the body relative to the support member.

8. The lighting apparatus of claim 1, wherein the connection member includes a first recess and an inserting projection provided in the first recess, and the support member includes a surrounding projection to be provided in the first recess, and a second recess provided within the surrounding projection, the second recess to receive the inserting projection.

9. The lighting apparatus of claim 8, further comprising a screw that passes through the second recess and attaches to the inserting projection.

10. The lighting apparatus of claim 8, wherein a first contact and a second contact are provided on surfaces of the support member that extend from the surrounding projection, the first contact and the second contact for contacting the first stopper and the second stopper, respectively.

11. The lighting apparatus of claim 10, wherein the first stopper is provided on a first surface of the first recess and the second stopper is provided on a second surface of the first recess.

12. The lighting apparatus of claim 10, wherein the first stopper and the second stopper have different slope angles.

13. The lighting apparatus of claim 1, further comprising a power supply unit to electrically connect to the light emitting module, and a cable to pass through the connection member and the support member to connect the power supply unit to the light emitting module.

14. A lighting apparatus comprising:

a body having a light emitting module with a light emitting diode (LED);

a connection member to couple to the body, the connection member including a first stopper and a second stopper; and a support member to couple to the connection member and provide the body at a specific tilt angle, the support member including a first contact and a second contact, wherein the first stopper stops movement of the body relative to the support member when the first stopper contacts the first contact, and the second stopper stops movement of the body relative to the support member when the second stopper contacts the second contact, wherein the light emitting module to provide light in a first light direction when the body is in a first tilt position relative to the support member, and the light emitting module to provide light in a second light direction when the body is in a second tilt position relative to the support member.

15. The lighting apparatus of claim 14, wherein the connection member further includes a first plurality of projections, and the support member further includes a second plurality of projections to engage with the first plurality of projections for adjusting a position of the body relative to the support member.

16. The lighting apparatus of claim 15, wherein the first projection portion includes a first plurality of projections spaced at intervals on the connection member, and the second projection portion includes a second plurality of projections spaced at intervals on the support member.

17. The lighting apparatus of claim 14, wherein the connection member includes a first recess and an inserting projection provided in the first recess, and the support member includes a surrounding projection and a second recess provided within the surrounding projection, the second recess to receive the inserting projection.

18. The lighting apparatus of claim 17, further comprising a screw that passes through the second recess and attaches to the inserting projection.

19. The lighting apparatus of claim 17, wherein the first contact and the second contact are provided on surfaces of the support member that extend from the surrounding projection, the first contact and the second contact for contacting the first stopper and the second stopper, respectively.

20. The lighting apparatus of claim 14, further comprising power supply unit to electrically connect to the light emitting module, and a cable to pass through the connection member and the support member to connect the power supply unit to the light emitting module.

* * * * *